US009347116B2

(12) United States Patent
Li et al.

(10) Patent No.: US 9,347,116 B2
(45) Date of Patent: May 24, 2016

(54) PROCESS OF SEPARATING AND PURIFYING THORIUM

(71) Applicant: Changchun Institute of Applied Chemistry, Chinese Academy of Sciences, Changchun (CN)

(72) Inventors: Deqian Li, Changchun (CN); Yanliang Wang, Changchun (CN); Wuping Liao, Changchun (CN)

(73) Assignee: CHANGCHUN INSTITUTE OF APPLIED CHEMISTRY, CHINESE ACADEMY OF SICENCES, Changchun (CN)

( * ) Notice: Subject to any disclaimer, the term of this patent is extended or adjusted under 35 U.S.C. 154(b) by 119 days.

(21) Appl. No.: 13/777,315

(22) Filed: Feb. 26, 2013

(65) Prior Publication Data

US 2014/0170039 A1 Jun. 19, 2014

(30) Foreign Application Priority Data

Dec. 18, 2012 (CN) ..... 2012 1 0552752

(51) Int. Cl.
*C22B 60/02* (2006.01)

(52) U.S. Cl.
CPC ..... *C22B 60/0291* (2013.01)

(58) Field of Classification Search
None
See application file for complete search history.

(56) References Cited

U.S. PATENT DOCUMENTS

| | | | | |
|---|---|---|---|---|
| 2,945,742 | A * | 7/1960 | Christensen et al. | 423/10 |
| 3,104,940 | A * | 9/1963 | Krumholz et al. | 423/10 |
| 3,825,649 | A | 7/1974 | Gresky et al. | |
| 2006/0153760 | A1 * | 7/2006 | Meikrantz et al. | 423/8 |

FOREIGN PATENT DOCUMENTS

| | | | |
|---|---|---|---|
| CN | 1254024 | | 5/2000 |
| CN | 1254024 | A * | 5/2000 |
| CN | 102417992 | | 4/2012 |
| FR | 2678644 | A1 * | 1/1993 |
| GB | 907187 | | 10/1962 |
| GB | 1219305 | A * | 1/1971 |

OTHER PUBLICATIONS

G. Bernstein, et al., A high-capacity annular centrifugal contactor, Nuclear Technology 20;200-202 (1973).*
Office Action issued in Chinese Patent Application No. 201210552752.X, issued on Jul. 15, 2013 (with translation).
Patent Examination Report No. 1 issued Apr. 30, 2014 in Australian Application No. 2013201027 (8 pages).

* cited by examiner

*Primary Examiner* — Melissa Swain
(74) *Attorney, Agent, or Firm* — Nixon & Vanderhye P.C.

(57) ABSTRACT

The present invention relates to a process of separating and purifying thorium by solvent extraction, comprising: 1) mixing a thorium enrichment with an inorganic acid to produce a feed; 2) mixing a neutral phosphorus extractant with an organic solvent to obtain an organic phase; 3) extracting from the feed with the organic phase to obtain a loaded organic phase; 4) scrubbing the loaded organic phase with a scrubbing solution and then back-extracting thorium with a stripping solution to obtain a thorium solution; 5) mixing the thorium solution with an oxalate to obtain a precipitate, which is then sintered to obtain thorium oxide. The present process allows to increase the purity of thorium from 80%-99% to 99.99% or more with a yield of more than 98%.

15 Claims, 1 Drawing Sheet

PROCESS OF SEPARATING AND PURIFYING THORIUM

CROSS REFERENCE OF THE RELATED APPLICATION

This application claims the benefit of the priority of the Chinese invention patent application No. 201210552752.X filed with SIPO of China on Dec. 18, 2012, the disclosure thereof is incorporated herein by reference by their entirety, as totally described herein.

TECHNICAL FIELD

The present invention relates to a process of separating and purifying thorium, more specially, to a process of purifying thorium by solvent extraction.

BACKGROUND

As one of the important elements in the research and development of nuclear energy, thorium element itself does not decay easily, but may be converted to fissile U-233 after absorbing a neutron, and thus is a very promising nuclear fuel. Thorium is abundant in the earth's crust with a content of about 6 ppm, which is about 3 times of that of uranium. In china, thorium is mainly associated in rare earth ores and has a total reserve of about 280-300 thousand tons. Currently in China, however, the utilization rate of thorium is almost zero. In the production of rare earth (RE), thorium is discharged to the tailing dam or the neutralized slag of rare earth, which results in a large radioactive safety risk and a huge resource waste. Once there is breakthrough in the research of thorium nuclear energy, huge benefit will be brought and the dependency on oil will be largely released. Thus, it is of great interest to recover and purify thorium.

Chinese patent application No. 98122348.6 and 02123913.4 disclosed two processes of recovering thorium during extraction and separation of rare earth from rare earth ores (Baotou mixed bastnasite-monazite ore and Sichuan bastnasite), in which a primary amine ($R—NH_2$) is used as an extractant and thorium was recovered and enriched from about 0.2% (in refined rare earth ore) to 95-99% with a thorium recovery of 95%. Gupta in Indian studied recovering and separating thorium, uranium and rare earth from monazite with Cyanex 923 (Journal of Radioanalytical and Nuclear Chemistry, 251 (2002) 451-456), and found that thorium and uranium could be extracted in a medium of 5.0 mol/l nitric acid, and then thorium was back-extracted by 2.0 mol/l hydrochloric acid and uranium was stripped by 0.5 mol/l sulfuric acid. However, the process concerned these results are not reported.

To meet the requirement for the research and power generation of thorium nuclear energy, thorium used as a nuclear fuel must be at nuclear purity level, so the thorium enrichments from rare earth ores or other resources must be purified further. In an early process, tributyl phosphate (TBP) is used as an extractant to extract and purify thorium from the thorium hydroxide enrichments obtained from the processing of monazite (W U Huawu, Nuclear Fuel Chemical Technology, Atomic Energy Press, 1989, p. 164). In this process, a TBP extraction system was adopted to separate uranium and purify thorium, using a thorium hydroxide enrichment obtained from the processing of monazite as the feed. FIG. 1 shows the flow chart of the process, in which Ss represents the acidized organic phase, F represents the feed, W represents the scrubbing solution, St represents the stripping solution, Ac represents the acid for acidizing, R represents the extraction raffinate, and the other process parameters are shown in table 1.

TABLE 1 the process parameters for purifying thorium with TBP

| materials | | | Flow |
|---|---|---|---|
| name | abbreviation | composition | ratio |
| acidized organic phase | $Ss_1$ | 40 vol. % TBP-paraffin | 4 |
| acidized organic phase | $Ss_2$ | 40 vol. % TBP-paraffin | 0.8 |
| feed | F | 0.76 mol/l $Th(NO_3)_4$; which contains 4 mol/l $HNO_3$ and additional U, RE and Fe | 1 |
| scrubbing solution | W | 4 mol/l $HNO_3$ | 0.8 |
| stripping slotuion | $St_1$ | 0.1 mol/l $HNO_3$ | 4 |
| stripping solution | $St_2$ | 5% $Na_2CO_3$ | 3.2 |
| acid for acidizing | Ac | 4 mol/l $HNO_3$ | / |

However, the purification of thorium with TBP needs to be performed in a high concentration nitric acid medium, which results in a large consummation of the acid and an accelerated decomposition of TBP. In addition, TBP has a low molecular weight with a relative high solubility in water (0.64 g/L at 25° C.), which causes the running off of TBP and thus an increased cost.

SUMMARY OF THE INVENTION

The present inventors have devoted a long time to the research on the separation and purification of thorium. To address the above problems in the processes for separating and purifying thorium of the prior art such as large acid and TBP consumptions, the present inventors has designed a process of separating and purifying thorium and filed a Chinese patent application No. 201110074345.8. Based on above, the present invention is accomplished through further investigation. The process of separating and purifying thorium according to the present invention not only solves the technical problems in the prior art, but also reduces the cost and allows obtaining thorium with higher purity.

In one aspect of the present invention, provided is a process of separating and purifying thorium, comprising the steps of:

1) mixing a thorium enrichment with an inorganic acid to produce a feed;

2) mixing a neutral phosphorus extractant with an organic solvent to obtain an organic phase;

3) extracting from the feed with the organic phase to obtain a loaded organic phase;

4) scrubbing the loaded organic phase with a scrubbing solution (also referred as scrubbing acid) and then back-extracting thorium in the loaded organic phase with a stripping solution (also referred as back-extractant) to obtain a thorium solution;

5) mixing the thorium solution with an oxalate to obtain a precipitate, which is then sintered to obtain thorium oxide.

Preferably, the thorium compound in the thorium enrichment may be one or more selected from the group consisting of thorium oxalate, thorium hydroxide, thorium nitrate, thorium chloride and thorium oxide.

Preferably, the thorium enrichment contains the thorium compound in an amount of 80 wt %~99 wt %.

Preferably, the inorganic acid may be one or more selected from the group consisting of hydrochloric acid, nitric acid and sulfuric acid.

Preferably, the feed contains thorium in a concentration of 0.5~1.5 mol/l and the inorganic acid in a concentration of 0.5~5 mol/l.

Preferably, the neutral phosphorus extractant is represented as a general formula of $G_3P{=}O$, in which each G is independent one selected from alkyl and alkoxyl and at least one G is alkyl. The alkyl or alkoxyl is preferably C1-C20 alkyl or C1-C20 alkoxyl and more preferably C1-C10 alkyl or C1-C10 alkoxyl.

Preferably, the neutral phosphorus extractant may be one or more selected from the group consisting of di(2-ethylhexyl) 2-ethylhexyl-phosphonate, di(1-methylheptyl) methyl-phosphonate, Cyanex 923, dibutyl butyl-phosphonate and butyl dibutyl-phosphonate.

The extraction is preferably carried out in a series of separating funnels, mixer-settler extractors or centrifugal extractors, and more preferably centrifugal extractors.

Preferably, the organic solvent is alkane or aromatic hydrocarbon, preferably sulfonated paraffin or xylene.

Preferably, in the organic phase, the extractant and the organic solvent have a volume ratio of 10~60:40~90.

Preferably, the scrubbing solution is nitric acid, hydrochloric acid or sulfuric acid with a concentration of 1.0~4.0 mol/l; the stripping solution is water, diluted nitric acid or diluted hydrochloric acid.

Preferably, the stage numbers are 4~10 for the extracting, 0~8 for the scrubbing, and 2~8 for the back-extracting, respectively.

Separating funnels or a mixer-settler extractors may be used to perform the fractional extraction, in which the organic phase, the feed, the scrubbing solution and the stripping solution may be used in a flow ratio of 15~25:2~10:2~10:2~10, preferably 22:2~3:2~5:2~10. More preferably, centrifugal extractors may be used to perform the fractional extraction, in which the organic phase, the feed, the scrubbing solution and the stripping solution may be used in a flow ratio of 20~100:5~30:0~15:20~100.

Advantageous Effect

In present process, since a neutral phosphorus extractant is used, the used neutral phosphorus extractant may be recycled in the extraction and back-extraction, thus reducing the consumption of the inorganic acid and the extractant, decreasing the cost and improving the purity of thorium. The experimental results showed that the present process can obtain a thorium product with a purity of 99.995% or more and a recovery of more than 98%; and that the content of thorium (calculated as thorium oxide) in the extraction raffinate is less than 5 g/L.

BEST MODE FOR CARRYING OUT THE INVENTION

Figure 1:
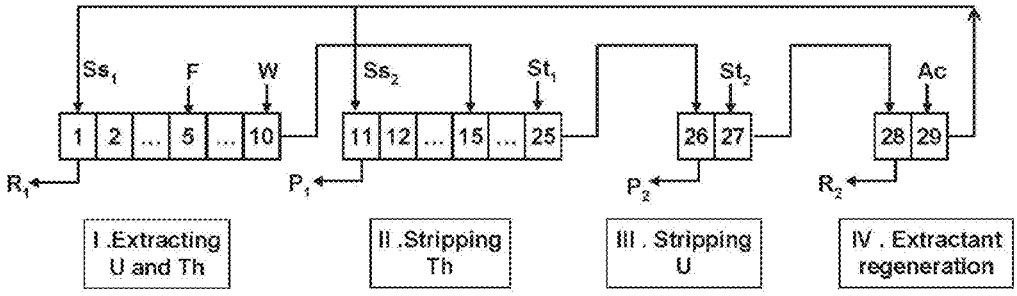
FIG. 1 is a flow chart of separating uranium and purifying thorium from a thorium enrichment obtained from monazite with TBP in the prior art.

The preferable embodiments according to the present invention will be described in detail for illustrating further the present invention, but the description is only for the purpose to illustrate the characteristics and advantages of the present invention without limiting the present invention.

According to the process of separating and purifying thorium of the present invention, first, a thorium enrichment and an inorganic acid are mixed to produce a feed, and a neutral phosphorus extractant and an organic solvent are mixed to obtain an organic phase; secondly, thorium in the feed is extracted into the organic phase by fractional extraction to produce a loaded organic phase, while the other impurities remain in the raffinate; thirdly, the loaded organic phase is washed with a scrubbing solution and then thorium is back-extracted from the loaded organic phase with a stripping solution to produce a thorium solution; and finally, the thorium solution is mixed with an oxalate to produce a precipitate, which is then sintered to obtain thorium dioxide.

Preferably, the thorium compound in the thorium enrichment may be thorium oxalate, thorium hydroxide, thorium nitrate, thorium chloride, thorium oxide, or a mixture thereof. Based on the total weight of the thorium enrichment, thorium compound is included in an amount of 80-99% by weight and the remaining are impurities such as rare earths, iron, etc. Preferably, to facilitate the treatment, a hydrous thorium enrichment is subject to be dried at a temperature of 100-150° C. and then sintered for 1 hour at a temperature of 400-600° C. And then the thorium enrichment is dissolved in an inorganic acid to obtain a thorium solution, which is then adjusted in the concentrations of thorium and the acid to the required levels, so as to obtain a feed.

There is no limitation to the source of the thorium enrichment, as long as the content of the thorium compound therein satisfies the present process. For example, the thorium enrichment may be a thorium regenerant recovered and enriched from the processing of Panxi bastnasite, Baotou mixed bastnasite-monazite ore, monazite ore or other ores. Alternatively, the thorium enrichment may be recovered and enriched from a thorium-containing ore, for example, by using the processes described in Chinese patent application No. 98122348.6 and 02123913.4.

In a preferable embodiment, the thorium enrichment may be produced by the steps of (a1) adjusting the concentration of an inorganic acid in a thorium-containing solution to 1.0-4.5 mol/l to produce a stock solution; and (a2) recovering thorium from the stock solution in a centrifugal extractor by using a primary amine or an organophosphorus ligand as the extractant, to obtain the thorium enrichment.

In step (a1), the thorium-containing solution is produced through the reaction of a thorium-containing mineral with an inorganic acid, for example, it may be a solution produced by reacting an inorganic acid with one selected from the group consisting of bastnasite, monazite, bastnasite-monazite, ion-adsorption rare earth deposit of South China, and a smelting slag therefrom, or a solution produced by reacting an inorganic acid with a thorium-containing slag generated in the smelting of other minerals. The inorganic acid is preferably nitric acid, hydrochloric acid or sulfuric acid.

In step (a2), the step of recovering thorium by centrifugal extraction includes the steps of extracting thorium from the stock solution into an organic phase to obtain a loaded organic phase, scrubbing the loaded organic phase with a scrubbing solution and then back-extracting thorium from the loaded organic phase with a stripping solution to produce a thorium solution, which is optionally concentrated to obtain the thorium enrichment or treated by precipitating, sintering and dissolving in nitric acid to obtain the thorium enrichment.

In step (a2), the organic phase consists of a primary amine or an organophosphorus extractant, a phase modifier and an organic solvent. There is no particular limitation to the primary amine or the organophosphorus extractant as long as it can extract efficiently thorium from the thorium-containing solution. The primary amine may preferably be one or more selected from N1923, N179 and N116. The organophosphorus extractant may preferably be one or more selected from Cyanex 923, 2-ethylhexylphosphonic acid mono-2-ethylhexyl ester, di(2-ethylhexyl)phosphoric acid, di(2-ethylhexyl) 2-ethylhexyl-phosphonate, di(1-methylheptyl)methyl-phosphonate, dibutyl butyl-phosphonate and butyl dibutyl-phosphonate. The phase modifier is for improving the phase separation between the organic phase and the aqueous phase and there is no particular limitation thereon, but the phase modifier may preferably be one or more selected from methyl heptanol and TBP. There is no particular limitation to the organic solvent as long as it can dissolve efficiently the primary amine or the organophosphorus extractant. The organic solvent may preferably be one or more selected from the group consisting of sulfonated paraffin, cyclohexane and xylene. The organic phase may be composed of the primary amine, the phase modifier and the organic solvent in a volume ratio of 0.5~10:0.5~10:80~99, or of the organophosphorus extractant, the phase modifier and the organic solvent in a volume ratio of 0.5~50:0.5~10:40~99.

In step (a2), the organic phase, the feed, the scrubbing solution and the stripping solution may be used in a flow ratio of 5~15:20~100:4~10:1~5. The stage numbers are 4-10 for the extracting, 2-6 for the scrubbing, and 2-8 for the back-extracting, respectively. The scrubbing solution is nitric acid or hydrochloric acid with a concentration of 0.01~1.0 mol/l, the stripping solution is nitric acid, hydrochloric acid or sulfuric acid with a concentration of 0.3~4.0 mol/l.

In the process of separating and purifying thorium according to the present invention, the inorganic acid is for leaching thorium in ionic form from a thorium enrichment so as to facilitate the following extraction. The inorganic acid may preferably be nitric acid, hydrochloric acid or sulfuric acid. Preferably, in the feed, the concentration of the inorganic acid is 0.5~10.0 mol/l.

In the process of separating and purifying thorium according to the present invention, the feed preferably includes thorium in a concentration of 0.5~1.5 mol/l. There is no particular limitation to the content of rare earth oxides (REOs) as long as it does not affect the separation and purification of thorium, but the content of REOs is preferably 50 g/L or less.

In the process of separating and purifying thorium according to the present invention, the neutral phosphorus extractant is preferably represented by a general formula of $G_3P{=}O$, wherein each G is an independent alkyl R or alkoxyl R—O, and at least one G is an alkyl. The carbon chains in the alkyls or the alkoxyls may be same or different. That is, the neutral phosphorus extractant may be one or more selected from the group consisting of trialkylphosphine oxide, alkyl dialkylphosphonate and dialkyl alkylphosphonate, more preferably one or more selected from the group consisting of di(2-ethylhexyl) 2-ethylhexyl-phosphonate (P503), di(1-methylheptyl)methyl-phosphonate (P350), dibutyl butyl-phosphonate (DBBP), butyl dibutyl-phosphonate (BDBP) and Cyanex 923. Among them, P503 is easy to be synthesized and has a solubility of $2.6\times10^{-4}$ g/L (25° C.) in the water with a cheap price and a good extraction effect. P350, which may be synthesized by using castor beans of China as raw material, has a solubility of 0.017 g/L (25° C.) in the water. Comparing dibutyl butyl-phosphonate (DBBP) and butyl dibutyl-phosphonate (BDBP) with tributyl phosphate (TBP), the replacement of alkoxyl by alkyl can decrease the water-solubility. Cyanex 923 is a new commercially available extractant developed by CYTEC (U.S.A), which consists of 42 wt % of hexyl dioctyl phosphine oxide, 31 wt % of dihexyl octyl phosphine oxide, 14 wt % of trioctyl phosphine oxide and 8 wt % of trihexyl phosphine oxide, and has a good extraction property. The organic solvent may preferably be selected from an alkane or an aromatic hydrocarbon, and more preferably sulfonated paraffin or xylene. In the organic phase, the extractant and the organic solvent may be used in a volume ratio of 10~60:40~90, and preferably 20~40:80~60.

In the process of separating and purifying thorium according to the present invention, the scrubbing solution is used to remove the impurities such as rare earth in the loaded organic phase. There is no particular limitation to the scrubbing solution, and the scrubbing solution is preferably nitric acid, hydrochloric acid or sulfuric acid with a concentration of 1.0~4.0 mol/l. The stripping solution is used to back-extract thorium from the loaded organic phase, as well as to regenerate the organic phase for recycling. There is no particular limitation to the stripping solution, and the stripping solution is preferably water or diluted nitric acid or diluted hydrochloric acid with a concentration of less than 0.5 mol/l.

In the process of separating and purifying thorium according to the present invention, there is no particular limitation to the extracting device for fractional extraction, as long as it can accomplish the extraction in the present invention. For example, the extracting device may be a device well known by the skilled person in the art, such as separating funnel, mixer-settler extractor or centrifugal extractor.

Preferably, the stage numbers are 4~10 for the extracting, 0~8 for the scrubbing, and 2~8 for the back-extracting, respectively.

In a preferable embodiment, separating funnels or mixer-settler extractors are used to perform the fractional extraction. In this case, the organic phase, the feed, the scrubbing solution and the stripping solution are used in a flow ratio of 15~25:2~10:2~10:2~10, preferably 22:2~3:2~5:2~10. The thorium product produced by this process may have a purity of 99.995~99.999%, preferably 99.998-99.999%, with a recovery of 98% or more.

In a more preferable embodiment, centrifugal extractors are used to perform the fractional extraction. In this case, the organic phase, the feed, the scrubbing solution and the stripping solution are preferably used in a flow ratio of 20~100:5~30:0~15:20~100. The experimental results showed that the thorium product produced by this process may have a purity of 99.999% or more with a recovery of 98% or more.

The utilization of centrifugal extractor to perform the extraction may overcome the defects of high volume occupation, large hold-up and high radioactivity in operation site of box extractor, and has advantages of small volume occupation, small hold-up, short stage residence time, high organic phase utilization rate and high treatment capacity under the same conditions. Meanwhile, the leak of thorium is effectively prevented and the radioactive risk is reduced, since the material is fully enclosed during transportation and transferring and it is easy to accomplish automated control.

Figure 2:
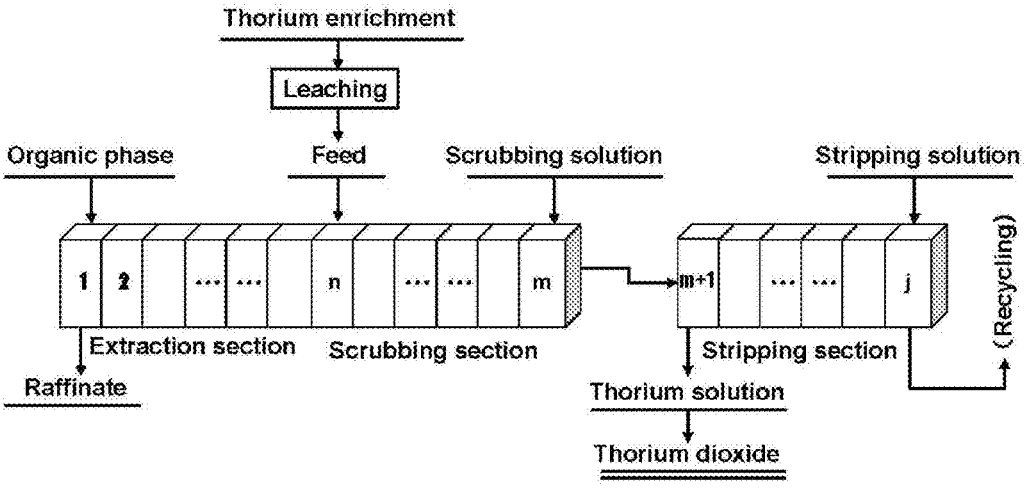
FIG. 2 is a flow chart of separating and purifying thorium with an extractant according to the present invention.

The flow chart of the process according to the present invention is shown in FIG. 2.

As shown in FIG. 2, n, m and j are the stage number of the fractional extraction respectively, wherein n=4~10, m=4~18, and j=6~26. The organic phase is fed in stage 1; the feed is fed in stage n and extracted by the organic phase, the raffinate is discharged from the lower part of stage 1; the scrubbing solution is fed in stage m; the stripping solution is fed in stage j and strips the scrubbed organic phase to obtain a thorium solution, which is discharged from stage m+1 and further treated to afford a thorium product. The organic phase after back-extraction is discharged from stage j and recycled.

EXAMPLES

The following examples are provided to further illustrate the technical solution of the present invention. The used chemical reagents are analytically pure.

Example 1

Preparation of a Feed:

Hydrous thorium oxalate (recovered in the processing of Panxi bastnasite of Sichuan) was dried at 150° C. and then sintered at 520° C. for 1 hour to afford 80 g of thorium oxide. The thorium oxide was dissolved with nitric acid completely. The resulted solution was diluted suitably and filtered to obtain the required feed. The analytic results gave that, in the feed, $C_{Th(NO3)4}$=1.50 mol/l, and $C_{HNO3}$=2.50 mol/l. The weight percentage of Thorium ($ThO_2$) was 95.36%, and the main impurity was rare earths. The content of uranium was less than 0.002%.

Preparation of Organic Phase:

800 ml of industrial di(2-ethylhexyl) 2-ethylhexyl-phosphonate (P503) was dissolved in solvent naphtha No. 260 and then diluted to 2000 ml. Here the extractant was included in a volume concentration of 40%.

Fractional Extraction:

The fractional extraction was carried out by using mixer-settler extractors during the whole extraction process, which included 5 extracting stages, 6 scrubbing stages and 4 stripping stages. The organic phase was fed at stage 1, the feed was fed at stage 5, the scrubbing solution was 2.5 mol/l nitric acid and fed at stage 11, and the stripping solution was high purity deionized water and fed at stage 15. The organic phase, the feed, the scrubbing solution and the stripping solution were in a flow ratio of 20:2.8:2.8:8. The mixing time was 8 minutes and the settling time was 5 minutes. Through the separation and purification in this process, the impurities such as rare earths remained in the extraction raffinate, while thorium entered into the back-extract and precipitated with potassium oxalate, and then the precipitate was sintered to provide a high purity thorium product. ICP-MS analysis showed that the thorium purity was 99.998% and the recovery was 98.5%. The organic phase was recycled with a stable extraction property.

Example 2

Preparation of a Feed:

Concentrated thorium nitrate was dissolved with 2.5 mol/l of nitric acid under heating. After settled and cooled completely, the resulted solution was diluted suitably and filtered to obtain 1.0 l of a feed. The analysis showed that, in the feed, $C_{Th(NO3)4}$=1.50 mol/l, and $C_{HNO3}$=2.52 mol/l. The weight percentage of Thorium ($ThO_2$) was 99.27%, and the weight percentages of some rare earth impurities were as follows: $La_2O_3$ 0.2%, $CeO_2$ 0.45%, $Pr_4O_6$ 0.01%, $Nd_2O_3$ 0.03%, $Y_2O_3$ 0.008%. The content of uranium is less than 0.002%.

Preparation of Organic Phase:

The procedure was the same as that in example 1.

Fractional Extraction:

The fractional extraction was carried out by using separating funnels in the whole extraction process, and the extraction stages included 6 extracting stages, 6 scrubbing stages and 6 stripping stages. The scrubbing solution was 2.5 mol/l nitric acid, and the back-extracting acid was 0.01 mol/l diluted nitric acid. The organic phase, the feed, the scrubbing solution and the stripping solution were in a flow ratio of 22:2.6:2.8:6. The stripped thorium was precipitated with oxalic acid and the precipitate was sintered to give a thorium oxide product with a purity of 99.999% and a recovery of 98.2%.

Example 3

Preparation of a Feed:

Hydrous thorium hydroxide enrichment (recovered in the processing of mixed ore in Baotou) was dried and sintered to give anhydrous thorium oxide. The thorium oxide was dissolved with nitric acid and then fed with a small of hydroxylamine hydrochloride solid to reduce iron. The resulted solution was diluted and filtered to prepare a feed. In the feed, $C_{Th(NO3)4}$=1.45 mol/l, and $C_{HNO3}$=2.50 mol/l. The weight percentage of thorium ($ThO_2$) was 90.5%, and the main impurities were rare earths. The content of uranium was less than 0.002%.

Preparation of Organic Phase:

An industrial P503 extractant was dissolved into solvent naphtha No. 260 to reach a concentration of 38% by volume, and then pre-saturated with 2.50 mol/l nitric acid once.

Fractional Extraction:

The fractional extraction was carried out by using mixer-settler extractors in the whole extraction process, and the extraction stages included 6 extracting stages, 6 scrubbing stages, 5 stripping stages and 3 acidizing stages. The scrubbing solution was 2.5 mol/l nitric acid, the stripping solution was high purity deionized water, and the organic phase was acidized with 2.5 mol/l nitric acid. And the organic phase, the feed, the scrubbing solution, the stripping solution and the acid for acidizing were in a flow ratio of 22:2.8:2.8:7:7. After the extraction reached a balance, the thorium back-extract was precipitated with potassium oxalate, and the precipitate was sintered to provide thorium oxide. ICP-MS analysis showed that the purity of thorium was 99.998% with a recovery of 98.0%.

Example 4

Preparation of a Feed:

The procedure was the same as that in example 1.

Preparation of Organic Phase:

800 ml of industrial P350 extractant was dissolved into xylene and diluted to 2000 ml, and the concentration of P350 was 40% by volume at this time.

Fractional Extraction:

The fractional extraction was carried out by using mixer-settler extractors in the whole extraction process, and the extraction stages included 5 extracting stages, 5 scrubbing stages and 4 stripping stages. The scrubbing solution was 2.0 mol/l nitric acid and the stripping solution was high purity deionized water. The organic phase, the feed, the scrubbing solution and the stripping solution were in a flow ratio of 22:2.8:2.5:4. The process was performed for one week to give a thorium product with a purity of 99.998% and a recovery of 98.5%.

Example 5

Preparation of a Feed:

Hydrous thorium hydroxide enrichment (produced in the processing of monazite) was dried at 150° C. and then sintered at 500° C. for 1 hour, to afford thorium oxide. The thorium oxide was dissolved with 40% sulfuric acid under heating and stiffing. After cooled, the resulted solution was diluted suitably and filtered. The analysis showed that, in the feed, $C_{Th(SO4)2}$=1.0 mol/l, and $C_{H2SO4}$=0.6 mol/l. The weight percentage of thorium ($ThO_2$) was 91%, and the content of the impurity uranium was 5%. Before the purification of thorium, uranium was separated by pre-extraction to make its content be less than 0.002%.

Preparation of Organic Phase:

A certain amount of Cyanex 923 extractant was dissolved in xylene to achieve a volume concentration of 40%.

Fractional Extraction:

The fractional extraction was carried out by using mixer-settler extractors in the whole extraction process, and the extraction stages included 5 extracting stages, 4 scrubbing stages and 4 stripping stages. The scrubbing solution was 0.6 mol/l sulfuric acid and the stripping acid was 1.5 mol/l hydrochloric acid. The organic phase, the feed, the scrubbing solution and the stripping solution were in a flow ratio of 12:1:0.8:4. The process was performed for one week to produce a high purity thorium product. ICP-MS analysis showed that the purity of thorium was 99.995% with a recovery of more than 98%. The organic phase had a stable extraction capacity.

The results in examples 1-5 showed that the present process can improve effectively the thorium purity to 99.998% or more. Moreover, the extractant can be recycled, the amount of acid used can be reduced and the cost is decreased, and thus the present process is suitable for industrial production.

Example 6

A hydrous thorium oxalate (recovered in the processing of bastnasite) was dried, sintered and dissolved with nitric acid to obtain a feed. In the feed, $C_{Th(NO3)4}$=395 g/l (calculated as $ThO_2$), and $C_{HNO3}$=2.52 mol/l. The main impurities were rare earths and the percentage of thorium ($ThO_2$/($ThO_2$+REO))=97.7%. 800 ml of industrial di(2-ethylhexyl) 2-ethylhexyl-phosphonate was dissolved in solvent naphtha No. 260 (sulphonated paraffin) and then diluted to 2000 ml. The volume concentration of the extractant was 40%.

A multistage series centrifugal extractor was used in the whole extraction process, and included 5 extracting stages, 2 scrubbing stages and 4 stripping stages. The rotation rate was controlled to 3000 rpm in the whole extraction process. The organic phase was fed at stage 1, the feed was fed at stage 5, the scrubbing solution was 2.5 mol/l nitric acid and fed at stage 11, and the stripping solution was high purity deionized water and fed at stage 15. The organic phase, the feed, the scrubbing solution and the stripping acid were in a flow ratio of 44:5.6:6:36. After the separation and purification in this process, the impurities such as rare earths remained in the raffinate, and thorium entered the organic phase.

ICP-MS analysis showed that the thorium product had a purity of 99.999% with a recovery of 98.5%. The organic phase was recycled with a stable extraction property.

Example 7

Thorium carbonate with a purity of 97% was dissolved with nitric acid to give a feed. In the feed, $C_{Th(NO3)4}$=365 g/l (calculated as $ThO_2$), and $C_{HNO3}$=2.52 mol/l. The main impurities were rare earths and the percentage of thorium ($ThO_2$/($ThO_2$+REO))=97%. 800 ml of industrial di(1-methylheptyl) methyl-phosphonate extractant was dissolved in solvent naphtha No. 260 (sulphonated paraffin) and then diluted to 2000 ml. The volume concentration of the extractant was 40%.

The purification of thorium was carried out by using a multistage series centrifugal extractor, which included 5 extracting stages, 1 scrubbing stages and 5 stripping stages. The rotation rate was controlled to 3500 rpm in the whole extraction process. The scrubbing solution was 3.0 mol/l nitric acid and the stripping acid was 0.1 mol/l nitric acid. The organic phase, the feed, the scrubbing solution and the stripping acid were in a flow ratio of 50:7.2:4.0:54. The thorium product had a purity of 99.99% with a recovery of 99%. The organic phase was recycled with a stable extraction property.

Example 8

A thorium carbonate enrichment containing 30% $ThO_2$ (obtained in the later stage for smelting monazite) was washed with water and then dissolved with nitric acid to obtain a feed. In the feed, $C_{Th(NO3)4}$=200 g/l (calculated as $ThO_2$), and $C_{HNO3}$=2.8 mol/l. 800 ml of industrial dibutyl butyl-phosphonate extractant was dissolved in solvent naphtha No. 260 (sulphonated paraffin) and then diluted to 2000 ml. The volume concentration of the extractant was 40%.

The purification of thorium was carried out by a multistage series centrifugal extractor, which included 5 extracting stages, 5 scrubbing stages and 5 stripping stages. The rotation rate was controlled as 4000 rpm in the whole extraction process. The scrubbing acid was 3.0 mol/l nitric acid and the stripping solution was high purity deionized water. The organic phase, the feed, the scrubbing acid and the stripping solution were in a flow ratio of 25:6.25:6.25:25. ICP-MS analysis showed that the thorium product had a purity of 99.99% with a recovery of 98%. The organic phase was recycled with a stable extraction property.

Example 9

A neutralized slag from ion-adsorption rare earth deposit of South China (a thorium carbonate enrichment) containing 25% $ThO_2$ was washed with water and then dissolved with nitric acid to give a feed, in which $C_{Th(NO3)4}$=210 g/l (calculated as $ThO_2$), and $C_{HNO3}$=3.0 mol/l.

The organic phase was the same as that in example 6.

A multistage series centrifugal extractor was used and included 5 extracting stages, 4 scrubbing stages and 5 stripping stages. The rotation rate was controlled as 4500 rpm in the whole extraction process. The scrubbing acid was 2.8 mol/l nitric acid and the stripping acid was 0.1 mol/l nitric acid. The organic phase, the feed, the scrubbing acid and the stripping acid were in a flow ratio of 25:6.25:6.25:25. ICP-MS analysis showed that the thorium product had a purity of 99.99% with a recovery of 98.1%. The rare earths in the raffinate were recovered by another extraction.

Example 10

An iron-thorium slag containing 15% $ThO_2$ (obtained in the processing of bastnasite) was washed with water and then dissolved with nitric acid to provide a feed. In the feed, $C_{Th(NO3)4}$=170 g/l (calculated as $ThO_2$), and $C_{HNO3}$=3.5 mol/l. 800 ml of industrial butyl dibutyl-phosphonate extractant was dissolved in xylene and then diluted to 2000 ml. The volume concentration of the extractant was 40%.

A multistage series centrifugal extractor was used and included 6 extracting stages, 6 scrubbing stages and 6 stripping stages. The rotation rate was controlled as 2800 rpm in the whole extraction process. The scrubbing acid was 3.0 mol/l nitric acid and the stripping acid was 0.1 mol/l nitric acid. The organic phase, the feed, the scrubbing acid and the stripping acid were in a flow ratio of 25:8.25:8.25:25. ICP-MS analysis showed that the thorium product had a purity of 99.99% with a recovery of 98%. The rare earth in the raffinate was recovered by another extraction.

The organic phase was recycled with a stable extraction property.

Example 11

A rare earth solution in sulfuric acid was prepared with a composition of 0.3 g/l $ThO_2$, 42 g/l REO and 1.2 mol/l $H_2SO_4$. A multistage series centrifugal extractor was used to recover thorium and its rotation rate was controlled as 4500 rpm. The organic phase had a volume composition of primary amine N1923:methyl heptanol:solvent=3:3:96. The organic phase, the feed, the scrubbing solution and the stripping solution were in a flow ratio of 10:37:4:1.4. The extraction included 6 extracting stages, 6 scrubbing stages and 6 stripping stages. The scrubbing solution was 0.03 mol/l nitric acid and the stripping solution was 1.0 mol/l nitric acid. Analysis showed that the purity of thorium was 98%. The back-extracted thorium solution was concentrated as a feed for further purification of thorium.

Next, a multistage series centrifugal extractor was used for the purification of thorium and included 6 extracting stages, 4 scrubbing stages and 4 stripping stages. The rotation rate was controlled as 4000 rpm. The organic phase was 40% di(1-methylheptyl)methyl-phosphonate-60% cyclohexane, the scrubbing solution was 3.0 mol/l nitric acid and the stripping solution was high purity deionized water. The organic phase, the feed, the scrubbing solution and the stripping acid were in a flow ratio of 44:6:6:44. After the separation and purification in this process, the impurities such as rare earths remained in the raffinate, and thorium entered the organic phase. Analysis showed that the thorium product had a purity of 99.999% with a recovery of 98%.

Example 12

A rare earth solution in nitric acid was prepared with a composition of 40 g/l $ThO_2$, 80 g/l REO and 2.5 mol/l $HNO_3$. A multistage series centrifugal extractor was used to recover thorium and its rotation rate was controlled as 3000 rpm. The organic phase had a volume composition of Cyanex 923: methyl heptanol:organic solvent=30:10:60. The organic phase, the feed, the scrubbing solution and the stripping solution were in a flow ratio of 20:17.5:6:10. The whole extraction included 4 extracting stages, 2 scrubbing stages and 3 stripping stages. The scrubbing solution was 1.0 mol/l nitric acid and the stripping solution was 0.53 mol/l oxalic acid. After back-extraction, the resulted thorium precipitate had a purity of 97%. The thorium precipitate was sintered and dissolved with nitric acid to provide a feed for further purification of thorium by centrifugal extraction.

Next, a multistage series centrifugal extractor was used for the purification of thorium and included 10 extracting stages, 6 scrubbing stages and 8 stripping stages. The rotation rate was controlled as 4500 rpm. The organic phase was 50% di(2-ethylhexyl) 2-ethylhexyl-phosphonate-50% xylene, the scrubbing solution was 1.0 mol/l nitric acid and the stripping acid was 0.2 mol/l hydrochloric acid. The organic phase, the feed, the scrubbing solution and the stripping acid were in a flow ratio of 44:6:6:44. After the separation and purification in this process, the thorium product had a purity of 99.999% with a recovery of 98%.

The results in the above examples 6-12 showed that, the utilization of a centrifugal extraction device for the separation and purification of thorium allowed a thorium product with a purity of 99.99% or more. Meanwhile, it has also the following technical advantages: (1) the device occupies small volume and has small hold-up, and the material is fully enclosed during transportation and transferring, which is more suitable for the purification of radioactive thorium; (2) the stage retention time is short and the organic phase has a high utilization efficiency; (3) the device is easy to be automatized.

The process of separation and purification of thorium according to the present invention has been described in detail in the above, and the principle and embodiments of the present invention have been illustrated by examples, but the above examples are only for the purpose of illustrating the present process and spirit thereof. It should be noted that, for an ordinary skilled person in the art, the present process may be modified and varied without departing from the spirit of the present invention, and such modification and variation also fall into the scope of the claims of the present invention.

What claimed is:

1. A process of separating and purifying thorium by solvent extraction, comprising the steps of:

1) mixing a thorium enrichment with an inorganic acid to produce a feed;
2) mixing a neutral phosphorus extractant with an organic solvent to obtain an organic phase;
3) extracting from the feed with the organic phase to obtain a loaded organic phase;
4) optionally, washing the loaded organic phase with a washing solution and then back-extracting thorium in the loaded organic phase with a stripping solution to obtain a thorium solution;
5) mixing the thorium solution with an oxalate to obtain a precipitate which is then sintered to obtain thorium oxide, wherein the neutral phosphorus extractant is represented by the general formula of $G_3P{=}O$, in which each G is independently selected from alkyl or alkoxyl, and at least one G is alkyl.

2. The process according to claim 1, wherein the thorium enrichment contains a thorium compound in an amount of 80 wt %~99 wt %.

3. The process according to claim 2, wherein the thorium compound is one or more selected from the group consisting of thorium oxalate, thorium hydroxide, thorium nitrate, thorium chloride and thorium oxide.

4. The process according to claim 1, wherein the neutral phosphorus extractant is one or more extractant selected from the group consisting of di(2-ethylhexyl) 2-ethylhexyl-phosphonate, di(1-methyl)heptyl methyl-phosphonate, dibutyl butyl-phosphonate, butyl dibutyl-phosphonate and a mixture of hexyl dioctyl phosphine oxide, dihexyl octyl phosphine oxide, trioctyl phosphine oxide and trihexyl phosphine oxide.

5. The process according to claim 1, wherein the organic solvent is an alkane or an aromatic hydrocarbon.

6. The process according to claim 1, wherein in the organic phase, the extractant and the organic solvent have a volume ratio of 10~60:40~90.

7. The process according to claim 1, wherein the inorganic acid is one or more selected from nitric acid, hydrochloric acid or sulfuric acid.

8. The process according to claim 1, wherein the feed contains thorium in a concentration of 0.5~1.5 mol/l and an inorganic acid in a concentration of 0.5~5 mol/l.

9. The process according to claim 1, wherein the extraction is carried out in a series of separating funnels, mixer-settler extractors or centrifugal extractors.

10. The process according to claim 9, wherein the extraction is carried out in a series of centrifugal extractors.

11. The process according to claim 9, wherein the separating funnels or the mixer-settler extractors are used to perform the fractional extraction, in which the organic phase, the feed, the washing solution and the stripping solution are set in a flow ratio of 15~25:2~10:2~10:2~10, or the centrifugal extractors are used to perform the fractional extraction, in which the organic phase, the feed, the scrubbing solution and the stripping solution are set in a flow ratio of 20~100:5~30:0~15:20~100.

12. The process according to claim 1, wherein the extracting is performed 4~10 times, the washing is performed 0~8 times, and the back-extracting is performed 2~8 times, respectively.

13. The process according to claim 1, wherein the washing liquid is nitric acid, hydrochloric acid or sulfuric acid with a concentration of 1.0~4.0 mol/l.

14. The process according to claim 1, wherein the stripping solution is water, diluted nitric acid or diluted hydrochloric acid.

15. The process according to claim 1, wherein the thorium enrichment is prepared by a process comprising the steps of (a1) adjusting the concentration of an inorganic acid in a thorium-containing solution to 1.0~4.5 mol/l to produce a stock solution; and (a2) recovering thorium from the stock solution using a primary amine or an organophosphorus ligand as an extractant in centrifugal extractors to obtain the thorium enrichment.

* * * * *